US005339585A

United States Patent [19]

Mollenkopf et al.

[11] Patent Number: 5,339,585

[45] Date of Patent: Aug. 23, 1994

[54] RACEWAY SWIVEL SPACER LEG ASSEMBLY

[75] Inventors: Lloyd C. Mollenkopf, Apple Valley; Russell J. Rein, St. Louis Park, both of Minn.

[73] Assignee: Rosemount Office Systems, Inc., Lakeville, Minn.

[21] Appl. No.: 938,010

[22] Filed: Aug. 28, 1992

[51] Int. Cl.[5] ..... E04H 1/00

[52] U.S. Cl. ..... 52/220.7; 52/241

[58] Field of Search ..... 52/220.7, 241, 242

[56] References Cited

U.S. PATENT DOCUMENTS

| | | | |
|---|---|---|---|
| Re. 31,733 | 11/1984 | Haworth et al. | 339/4 |
| 2,269,384 | 1/1942 | Spinosa | 52/242 |
| 3,513,606 | 5/1970 | Jones | 52/241 |
| 4,043,626 | 8/1977 | Propst | 52/242 |
| 4,277,123 | 7/1981 | Haworth | 339/22 R |
| 4,391,073 | 7/1983 | Mollenkopf | 52/241 |
| 4,596,098 | 6/1986 | Finkbeiner | 52/239 X |
| 4,713,918 | 12/1987 | Cioffi | 52/242 X |
| 4,899,018 | 2/1990 | Sireci | 174/48 |
| 4,918,886 | 4/1990 | Benoit et al. | 52/221 |
| 5,175,969 | 1/1993 | Knauf | 52/220.7 X |
| 5,207,037 | 5/1993 | Giles et al. | 52/220.7 X |
| 5,212,918 | 5/1993 | Newhouse et al. | 52/220.7 X |

*Primary Examiner*—Carl D. Friedman
*Assistant Examiner*—Beth A. Aubey
*Attorney, Agent, or Firm*—Westman, Champlin & Kelly

[57] ABSTRACT

An apparatus is disclosed for separating a portion of a wall that defines a raceway beneath a divider wall panel from the divider wall panel. The apparatus includes a swivel spacer leg seating member and a swivel spacer leg. A portion of the swivel spacer leg is offset, which allows a device such as an electric power distribution system to be mounted in the raceway with the spacer leg. The spacer leg seats in the swivel spacer leg seating member and swivels to allow the device to mounted in the raceway in a desired orientation.

17 Claims, 2 Drawing Sheets

RACEWAY SWIVEL SPACER LEG ASSEMBLY

BACKGROUND OF THE INVENTION

The present invention relates to a swiveling spacer leg apparatus for supporting a portion of a wall that defines a raceway beneath a divider wall panel in position spaced from the divider wall panel.

Spacer legs in raceways are commonly known to those skilled in the art. The spacer legs are used to control the spacing of walls defining the raceway in order to prevent undesirable bowing or deflection thereof. However, a problem with the spacer legs currently in use is that they generally extend directly down from the bottom of a divider wall panel to a center base portion of the raceway.

Placement of a support in the center of the raceway, as in U.S. Pat. No. 4,899,018, divides the raceway in half and thus limits the maximum cross sectional area of a cable or other assembly, such as an electrical distribution system, which can be placed in the raceway to less than half of the cross sectional area of the raceway. Placement of permanent supports along the peripheral edges of the raceway opens up the raceway to allow installation of cables or other assemblies with a cross sectional area in excess of half the cross sectional area of the raceway, but prevent installation of the cable by simply sliding it into the side opening. Instead, the cable is required to be threaded or fished past the side supports to complete installation.

In the present invention, a main upright portion of the spacer leg is offset from a central axis, thus allowing the device to be accommodated inside the raceway along with the swivel spacer leg assembly. The cable or other assembly can also be installed from either of two open sides of the raceway without the need to thread or fish the cable past the support.

SUMMARY OF THE INVENTION

The present invention is a swivel spacer leg assembly positioned inside a raceway beneath a bottom edge of a divider wall panel. The swivel spacer leg supports a portion of a wall that defines the raceway in position spaced from the divider wall panel to prevent that raceway wall as well as other walls of the raceway from bowing or deflecting. The swivel spacer leg further allows a device, such as an electric power distribution system to be mounted within the raceway with the swivel spacer leg in place.

The spacer leg assembly is comprised of two portions, a swivel spacer leg seating member, and a swivel spacer leg. The swivel spacer leg seating member is fixedly attached to the bottom surface of the divider wall panel. The spacer leg has a swivel head portion that fits in the seating member and a base portion that rests in a base channel portion of the raceway. In between the swivel portion and the base portion of the spacer leg is a main upright support portion. The main upright support portion is offset from a central axis of the swivel portion and base portion to allow the device, such as an electrical wiring assembly or conduit for other equipment to be accommodated inside the raceway along with the spacer leg assembly.

A benefit of the present invention is that the devices are generally installed in the wall panel, after a series of wall panels have been connected to form a partition or the like. By having the ability to rotate or swivel the spacer leg, the person doing the installation of the devices or equipment in the raceway can rotate the support to get the offset portion of the leg oriented to permit quick and easy installation of the equipment in the raceway in a preselected or desired orientation.

DETAILED DESCRIPTION OF THE PREFERRED EMBODIMENTS

Figures 1, 1A:
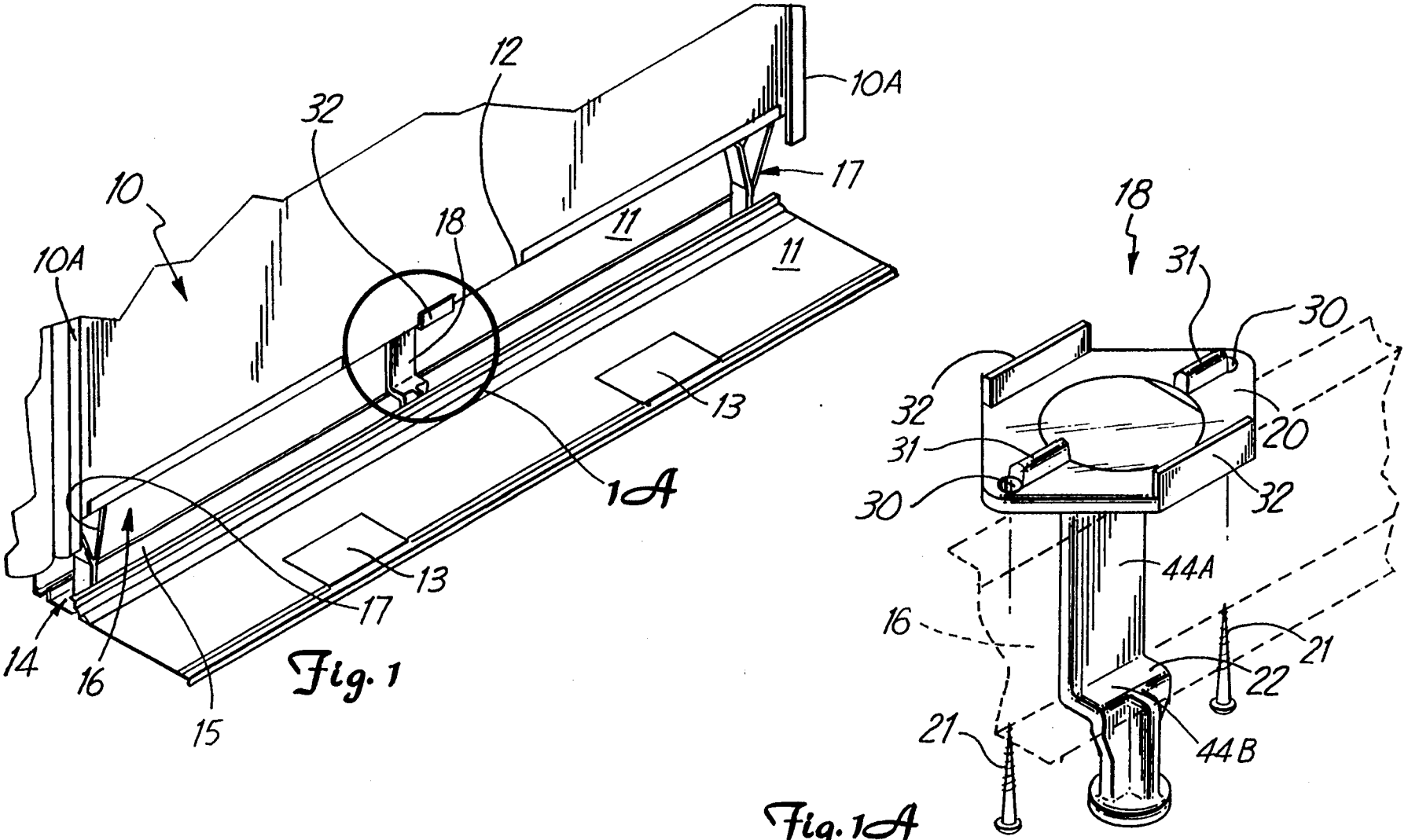
FIG. 1 is a perspective view of the swivel spacer leg assembly of the present invention located in a raceway.
FIG. 1A is an enlarged perspective view of the swivel spacer leg assembly.

The present invention, illustrated in FIG. 1, is a swivel spacer leg assembly 18 positioned inside a raceway 16 located beneath a divider wall panel 10. Divider wall panels, such as panel 10, are used extensively in commercial offices to form larger walls or partitions that separate a large floor space into smaller work spaces. The divider wall panels can also be joined together end to end along a straight line to form a large wall. Alternatively, the panels can be joined at a desired angle to form walls that are not coplanar.

Figure 2:
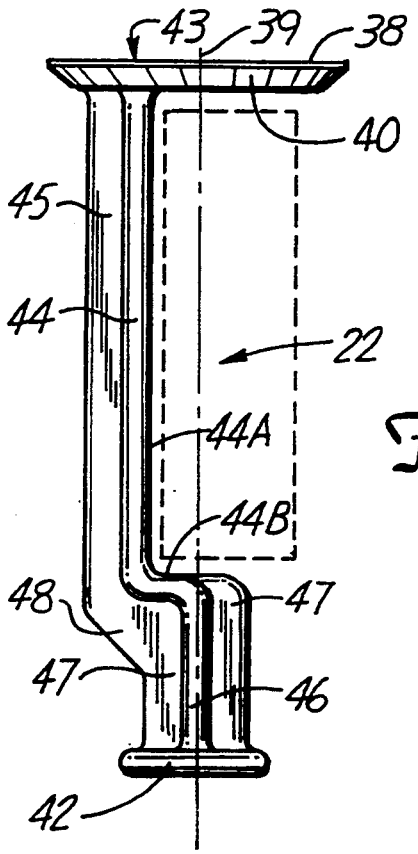
FIG. 2 is a side elevational view of the swivel spacer leg.

Raceways 16 beneath divider wall panels 10 are well known to those skilled in the art, and are provided to enclose computer, telephone, and electrical wiring, either in metal conduits, molded assemblies or wiring harnesses needed in the office floor space for each workspace. The raceway 16 typically is defined by hinged side walls 11 through which outlet holes 13 may be cut, a base plate 15 to which the side walls 11 are hinged, a base channel 14 which is formed in the base plate 15, and a bottom surface 12 of the divider wall panel 10. The divider wall panel 10 is supported above the base plate 15 with suitable support legs 17. Conduits, such as that shown in dotted lines in FIG. 2, are located within the raceway 16 in a desired orientation with respect to the divider wall panel. For example, these devices include electric power distribution systems which are mounted within the raceway 16 to provide power to a particular cubicle. Other devices include cabling or conduits necessary to bring communication signals, computer data or the like throughout the office space. Besides electric power outlets, the outlet holes can be of shape to accommodate telephone and computer jacks as desired. A swivel spacer leg assembly 18 allows the leg to be oriented within the raceway 16 with respect to the divider wall panel, so the recess formed by the offset is facing toward the correct side of the raceway. The spacer leg will continue to maintain proper spacing of the walls and prevent bowing or deflection of the base plate 15 or the raceway walls 11. Referring to FIG. 1A, the swivel spacer leg assembly 18 includes a swivel spacer leg seating member 20 and a swivel spacer leg 22. In a preferred embodiment, both the seating member 20 and the swivel spacer leg 22 are made of injected molded plastic, but any suitable material may be used.

Figure 3:
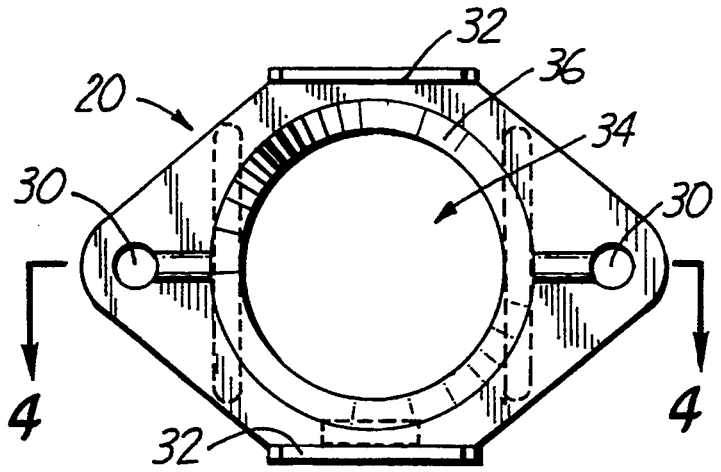
FIG. 3 is a top elevational view of the swivel spacer leg seating member.
Figure 4:
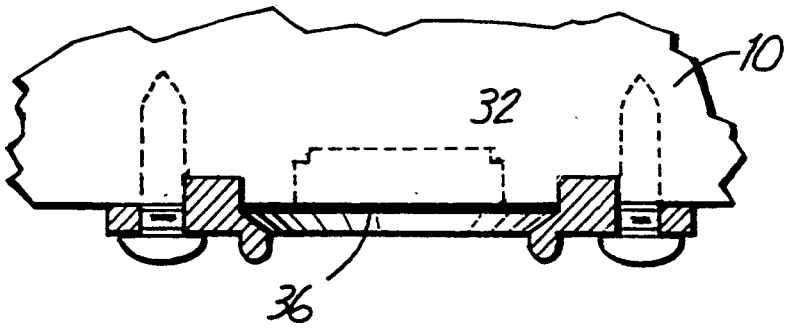
FIG. 4 is a cross-sectional view of the swivel spacer leg seating member taken along line 4—4 in FIG. 3.

Referring also to FIGS. 3 and 4, apertures 30 are provided on the swivel spacer leg seating member 20 for fastening means 21 of a type well known used to fasten the seating member to the bottom of the wall panel. Side walls or lips 32 are also provided on the seating member 20 to fit around the bottom surface 12 of the divider panel 10 as illustrated in FIG. 1. Bosses 31, formed on the upper surface of seating member 20, are located in corresponding grooves, not shown, in the bottom surface 12 of the divider wall panel 10, to align the assembly 18. An opening 34, preferably a circular hole, with a beveled edge 36 is provided to allow the spacer leg 22 to protrude through the hole 34 and be seated on the beveled edge 36.

Referring to FIG. 2, a rounded swivel head plate 38 having a beveled edge 40 is provided at a top portion of the swivel spacer leg 22. The beveled edge 40 of the top swivel plate 38 mates with the beveled edge 36 of the hole 34 in the seating member 20 so the surfaces slide to permit swiveling the spacer leg 22 relative to the stationary seating member 20.

The top plate 38 is joined to an upright support column 44. The upright support column 44 is generally perpendicular to the top swivel plate 38 and the base plate 42. The upright support column 44 is offset from a central axis 39 that passes through the top plate 38 and has a planar surface 44A that is generally oriented parallel to raceway 16. The offset portion forms a recess that is open to one side of the support leg. The upright support column 44 rotates about the central axis 39. Although shown with a top plate 38 and hole 34 that allows the upright support column to rotate 360 degrees around the central axis 39, partial rotation may be all that is required to allow the device to be oriented within the raceway 16.

A rib 45 runs longitudinally along the length of the upright support column 44 to provide added strength for support. The rib 45 is on a side surface opposite surface 44A and away from the central axis 39 so as to not interfere with mounting of the desired device.

A circular base plate 42 lies along the central axis 39 below the top swivel plate 38. The base plate 42 sits in the base channel 14 of the raceway 16, as illustrated in FIG. 1. A smaller shank 46 is connected to the base plate 42 and lies along the central axis 39. The shank 46 is of a size to extend vertically above the base channel 14 of the raceway 16. An angular bend 48 connects the shank 46 with the upright support column 44 and provides a surface 44B generally perpendicular to central axis 39. Two ribs 47 positioned on opposite side surfaces of shank 46 and connected to base portion 42 run the length of the shank 46 and further strengthen the shank 46.

The support column 44 is preferably joined to top plate 38 at a location 43 spaced apart from central axis 39. Offset joining of support column 44 with top plate 38 as at location 43 maximizes the height of surface 44A yet retains a preferred height of surface 44B above channel 14, which is the combined height of base plate 42 and shank 46. Preferably, the base plate 42, shank 46, support column 44, and top swivel plate 38 are integrally connected together to form the single molded piece or assembly 22.

When in use, the seating member 20 is fixedly mounted to the bottom surface 12 of a divider panel 10 with the fastening means 21 through apertures 30. Prior to mounting the seating member 20 to the divider panel 10, the swivel leg 22 is inserted through the hole 34 in the seating member 20 and the beveled edge 40 of the swivel portion 38 mates with the beveled edge 36 of the hole 34. The circular base portion 42 of the swivel leg 22 is then inserted into the base channel 14 of the raceway 16. When the assembly 18 is in this mounted position, the swivel leg 22 is free to rotate about the central axis 39, but a sufficient force is present to prevent upward bowing of the base plate 15, which in turn prevents outward bowing of the raceway walls 11. Specifically, contact of the top plate 38 with the lower surface 12 of the wall panel 10 prevents upward movement of the swivel leg 22 and thus upward movement of the base plate 15, while contact of the beveled mating surfaces allows the swivel leg to rotate about the central axis 39. The relatively large top plate 38 provides a secure base plate to keep the upright support column 44 and shank 46 substantially perpendicular to the base plate 15.

Generally, in a divider wall panel approximately 42–48 inches long, a single swivel spacer leg assembly 18 is used as is shown in FIG. 1 to control bowing of the base plate 15. For longer divider panels such as 60 inches in length, two swivel spacer leg assemblies 18 may be required. Of course, when multiple spacer legs are used, appropriate spacing between the each spacer leg would be maintained.

A benefit of the present invention is that the aforementioned devices (conduits, power distribution systems, wiring harnesses) are generally installed in the field after the panels 10 have been connected to form larger walls. It is then simpler and easier to rotate the swivel leg spacer 22 to allow the device to be properly oriented within the raceway 16 than to try to turn a divider wall panel around or completely remove the spacer leg 22 and reinstall the leg with a different orientation. For example, with the divider wall panels already in place in offices or wherever, furniture may be in the way, or the divider wall panels may be positioned against other fixed walls. By having the ability to rotate or swivel the spacer leg 22, the installer of the device is able to quickly and easily orient and install devices or equipment in the raceway 16 to face outward from the desired side of the divider wall panel 10. Proper orientation is achieved by simply rotating the swivel leg 22 until the main upright support column 44, which is offset, is away from the installer leaving the recess formed open toward the desired side. If there was not an offset portion to the swivel leg 22, there would not be room for the device or equipment in the raceway 16.

Although the present invention has been described with reference to preferred embodiments, workers skilled in the art will recognize that changes may be made in form and detail without departing from the spirit and scope of the invention.

What is claimed is:

1. An apparatus to support a portion of a wall defining a raceway associated with a divider wall panel, the apparatus comprising:

a stationary member adapted to be joined to a divider wall panel;

a spacing support structure rotationally connected to the stationary member about a central axis and being elongated along the central axis with a portion disposed in the raceway, the spacing structure having a wall portion laterally offset from the central axis to form a receptacle open to one side of the raceway and wherein the offset portion is within the raceway and rotatable at least partially about the central axis to permit moving the one open side of the offset portion to a desired location about the central axis after the stationary member is joined to a divider wall panel.

2. The apparatus as in claim 1 wherein the stationary member has an opening on the axis, and the spacer structure has a portion passing through the opening; and wherein the spacing structure is connected with the stationary member with mating surfaces about a portion of the axis.

3. The apparatus as in claim 2 wherein the mating surfaces of the stationary member and the spacing structure are beveled.

4. The apparatus as in claim 1 wherein the spacing structure includes a base portion contacting a surface of the portion of the wall defining the raceway.

5. The apparatus as in claim 4 wherein the base portion is positioned on the axis.

6. The apparatus as in claim 1 wherein the offset portion is elongated in direction along the axis and is offset from the axis a sufficient distance to form a recess opening to a lateral side to allow a device mounted within the raceway and extending along the raceway to fit within the recess.

7. The apparatus as in claim 6 wherein the device comprises an electric power distribution system.

8. An apparatus to control separation of a portion of a raceway beneath and relative to a divider wall panel, the apparatus comprising:

a stationary plate having means to join the stationary plate to a divider wall panel, the stationary plate having an opening with inner surfaces; and a spacing leg disposed in the raceway and having a top portion and a base portion defining a central upright axis and a middle portion being offset from the central upright axis to define a laterally opening receptacle for receiving the portion of the raceway, the top portion having corresponding surfaces that mate with the inner surfaces to allow at least partial rotation of the middle portion about the central upright axis.

9. The apparatus as in claim 8 wherein the mating surfaces of the stationary plate and the top portion are beveled.

10. The apparatus as in claim 9 wherein the stationary plate is joined to a bottom portion of the divider wall panel.

11. The apparatus as in claim 10 wherein the top portion comprises a swivel plate corresponding to the opening, and wherein the middle portion extends from a lower surface of the swivel plate at a location offset from the central axis.

12. An apparatus for controlling separation of a raceway relative to a divider wall panel and to allow a device extending along the raceway to be located i the raceway with desired orientation with respect to the divider wall panel, the apparatus comprising:

a spacing structure having means for rotationally connecting the structure to a divider wall panel in position to be disposed in the raceway, the spacing structure having a portion offset from a central upright axis of the spacing structure to form a recess opening to one lateral side of the structure and extending downwardly from a bottom of a divider wall panel to which the structure is connected and wherein the offset portion is rotatable at least partially about the central upright axis and offset a sufficient distance from the central upright axis to allow desired orientation of the opening of the recess.

13. The apparatus as in claim 12 and a stationary member formed to the divider wall panel and having an opening on the axis, and the spacer structure having a portion passing through the opening; and wherein the spacing structure is supported by the stationary member with mating surfaces about a portion of the axis for forming the rotational connection.

14. The apparatus as in claim 13 wherein the mating surfaces of the stationary member and the spacing structure are beveled.

15. The apparatus as in claim 14 wherein the spacing structure includes a base portion contacting a surface of the wall of the raceway.

16. The apparatus as in claim 15 wherein the base portion is positioned to be substantially centered on the axis.

17. The apparatus as in claim 12 wherein the device comprises an electric power distribution system.

* * * * *

UNITED STATES PATENT AND TRADEMARK OFFICE

CERTIFICATE OF CORRECTION

PATENT NO. : 5,339,585

DATED : August 23, 1994

INVENTOR(S) : Lloyd C. Mollenkopf et al.

It is certified that error appears in the above-indentified patent and that said Letters Patent is hereby corrected as shown below:

In the Abstract:

Line 10, before "mounted" insert --be--.

Col. 5, Line 17, cancel "positioned", and insert --centered--

Col. 6, Line 11, cancel "i", and insert --in--

Col. 6, Line 39, cancel "the" (first occurrence), and insert --a--

Signed and Sealed this

Twentieth Day of December, 1994

*Attest:*

Bruce Lehman

BRUCE LEHMAN

*Attesting Officer*

*Commissioner of Patents and Trademarks*